US006152005A

United States Patent [19]

Ootsuka

[11] Patent Number: 6,152,005

[45] **Date of Patent: *Nov. 28, 2000**

[54] METHOD OF PUNCHING A PUNCH GUIDE HOLE IN A BLANK HOLDER OF A PUNCH ASSEMBLY A PUNCH ASSEMBLY AND A BLANK HOLDER

[75] Inventor: Yasuyuki Ootsuka, Kanagawa, Japan

[73] Assignee: Amada Metrecs Company, Limited, Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/886,444

[22] Filed: Jul. 1, 1997

[30] Foreign Application Priority Data

Jul. 3, 1996 [JP] Japan ..... P8-173816

[51] Int. Cl.[7] ..... B26D 7/06

[52] U.S. Cl. ..... 83/138; 83/139; 83/684; 83/686; 83/698.91

[58] Field of Search ..... 83/138, 139, 140, 83/142, 684–86, 698.91

[56] References Cited

U.S. PATENT DOCUMENTS

| | | | |
|---|---|---|---|
| 4,246,815 | 1/1981 | Hugo | 83/139 |
| 4,261,237 | 4/1981 | DiDonato et al. | 83/139 |
| 4,929,276 | 5/1990 | Chun et al. | 83/139 X |
| 5,176,057 | 1/1993 | Chun et al. | 83/139 |
| 5,438,897 | 8/1995 | Chun | 83/139 X |
| 5,701,790 | 12/1997 | Saito | 83/140 |

FOREIGN PATENT DOCUMENTS

| | | |
|---|---|---|
| 53-29586 | 7/1978 | Japan . |

*Primary Examiner*—M. Rachuba
*Attorney, Agent, or Firm*—Blank Rome Comisky & McCauley LLP

[57] ABSTRACT

There is provided a method comprising a process of lightly fitting a distal end portion of a projecting portion 25 of a blank holder 23 into a fitting groove 19 formed in a punch guide 5 so as to be momentarily held therein; and a process of fitting the projecting portion 25 of the blank holder 23 into the fitting groove 19 while punching a punch guide hole 23G in the blank holder 23 when a punching portion 7 of a punch body 9 of a punch assembly 1 is lowered for pressing the blank holder 23 against a die D so that the punch guide 5 descends. In the punch assembly 1 constructed in a manner that the punch body 9 is vertically movably housed in a punch guide 5, and the blank holder 23 is removably fitted into the fitting groove formed in the punch guide 5, the punch guide 5 and the blank holder 23 are formed with an inclined plane 5S and an inclined plane 23S at part of an outer peripheral face on the lower end portion of the punch guide 5 or part of an upper face of a flange of the blank holder 23, respectively.

4 Claims, 4 Drawing Sheets

METHOD OF PUNCHING A PUNCH GUIDE HOLE IN A BLANK HOLDER OF A PUNCH ASSEMBLY A PUNCH ASSEMBLY AND A BLANK HOLDER

BACKGROUND OF THE INVENTION

1. Field of the Invention

The present invention relates to a method of punching a punch guide hole in a blank holder of a punch assembly which is used in a state of being attached to a punch holder in a punch press such as a turret punch press, a punch assembly and a blank holder.

2. Description of the Related Art

A punch assembly in the related art has disclosed the construction that it comprises a punch body having a punching portion at its lower end portion being vertically movably housed in a punch guide which is vertically movably supported onto a turret-like punch holder of a turret punch press, and a plastic blank holder being removably fitted into a fitting groove formed in a lower end portion of a punch guide.

In the aforesaid related art, a cylindrical projecting portion of the blank holder is fitted into the fitting groove of the punch guide, and thereafter, the punch body is inserted into the punch guide. And then, the punching portion of the punch body is subjected to punching so as to punch a punch guide hole in the blank holder.

More specifically, according to the related art, in the case where the blank holder is attached to the punch guide, there is a need of previously removing the punch body from the punch guide so that the punching portion does not become obstructive. For this reason, there has arisen a problem that an attachment of the blank holder is considerably troublesome.

Moreover, in the case where the plastic blank holder is replaced with a new blank holder due to a deterioration or damage caused therein, there has arisen a problem that it is very difficult to remove the blank holder from the punch guide because the blank holder is fixedly fitted so as not to come off therefrom due to vibration, etc.

In the related art construction, in the case where the blank holder is made of a rigid plastic, there is a problem that a great pressing force is required when the blank holder is fitted into the groove of the punch guide. As the case may be, there has arisen a problem that an annular stopper convex portion which projects from an outer peripheral face of the projecting portion is chipped off therefrom.

Furthermore, in the case where the blank holder is made of a relatively soft material, there is a problem that the blank holder does not act and not exhibit its function and is lack of durability.

SUMMARY OF THE INVENTION

The present invention has been achieved with such points in mind.

It therefore is an object of the present invention to provide a method of punching a punch guide hole in a blank holder in which attachment of the blank holder to the punch guide and punching of the punch guide hole of the blank holder can be readily achieved.

It is another object of the present invention to provide a punch assembly in which removal of the blank holder can be readily achieved.

It is still another object of the present invention to provide a blank holder which can be readily fitted into the groove formed in the punch guide.

To achieve the object, according to a first aspect of the present invention, there is provided a method of punching a punch guide hole in a blank holder while attaching the blank holder to a lower end portion of a punch guide in a punch assembly constructed in a manner that a punch body having a punching portion at its lower end portion is vertically movably housed in the punch guide vertically movably supported onto a punch holder, comprising the steps of: fitting lightly a distal end portion of a cylindrical projecting portion of the blank holder into a fitting groove formed in the lower end portion of the punch guide so that the distal end portion is momentarily held in the blank holder; and fitting forcedly the projecting portion of the blank holder into the fitting groove formed in the punch guide and punching the punch guide hole in the blank holder by pressing a punch head of a punch body of the punch assembly so that the punch guide descends and presses the blank holder against a die provided opposite to the blank holder.

Thus, the blank holder is fitted into the fitting groove by taking use of a downward pressing force of a striker, etc., so that attachment of the blank holder to the punch guide and punching of the punch guide hole of the blank holder can be readily achieved.

According to a second aspect of the present invention, there is provided a punch assembly, comprising: a punch guide vertically movably supported onto a punch holder; a punch body having a punching portion at its lower end portion vertically movably housed in the punch guide; and a blank holder is removably fitted into a fitting groove formed in a lower end portion of the punch guide, wherein the punch guide or the blank holder being formed with an inclined plane constructed so that a distance between the punch guide and the blank holder is widened toward the outside thereof, at part of an outer peripheral face on a lower end portion of the punch guide or part of an upper face of a flange of the blank holder.

With the above construction, by forcing pawls of a removal tool to bits into the inclined plane so as to abut against the inclined plane, a component in a direction of removing the blank holder from the punch guide acts thereon, so that the removal of the blank holder can be readily achieved.

According to a third aspect of the present invention, as it depends from the second aspect, wherein the inclined plane is formed on the outer peripheral face on a lower end portion of the punch guide or on the upper face of the flange of the blank holder so as to gradually guide the pawls of the removal tool between the lower end portion of the punch guide and the flange of the blank holder.

Thus, a component in a direction of removing the blank holder from the punch guide acts thereon, so that the removal of the blank holder can be readily achieved, as described above.

According to a fourth aspect of the present invention, as it depends from the second or third aspect, the punch assembly further comprises an elastic member is interposed between the punch guide and the blank holder, wherein the blank holder is retained onto the punch guide by means of the elastic member.

Thus, attachment of the blank holder to the punch guide can be readily achieved regardless of material quality of the blank holder. Also, there is no problem such that protrusions of the blank holder is not chipped off when attaching the blank holder to the punch guide.

According to a fifth aspect of the present invention, as it depends from the second, third or fourth aspect, wherein the blank holder is made of a rigid resin or metal, and the lower end face of the punch guide and the flange of the blank holder face each other.

Thus, the blank holder sufficiently acts or exhibits its function in operating.

According to a sixth aspect of the present invention, as it depends from the second, third, fourth or fifth aspect, wherein the flange of the blank holder has a thickness thicker than a bottom portion on an inside of the projecting portion formed on the blank holder.

Thus, the projecting portion of the blank holder is securely fitted into a fitting groove formed in the punch guide while punching of a punch guide hole being carried out. Therefore, the punch guide hole can be accurately punched in the blank holder.

According to a seventh aspect of the present invention, there is provided a blank holder attached to a lower end portion of a punch guide of a punch assembly, comprising: a blank holder being formed with a fitting projecting portion being capable of fitting into a fitting groove formed in the lower end portion of the punch guide; and an elastic member at an outer peripheral face of the projecting portion being capable of fitting into a stopper concave portion having an inner circumferential groove formed in the punch guide.

Thus, the blank holder can be readily fitted into the groove formed in the punch guide.

According to a eighth aspect of the present invention, as it depends from the seventh aspect, the blank holder further comprises a flange on the outside of the projecting portion formed so as to have a thickness thicker than the bottom portion on the inner side of the projecting portion.

Thus, when attaching the blank holder to the punch guide while punching a punch guide hole in the blank holder, the punch guide hole can be accurately punched in the blank holder.

According to a ninth aspect of the present invention, as it depends from the seventh or eighth aspect, wherein the flange is at least symmetrically formed with an inclined plane at its upper face.

Thus, when removing the blank holder from the punch guide, the removal of the blank holder can be readily achieved.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
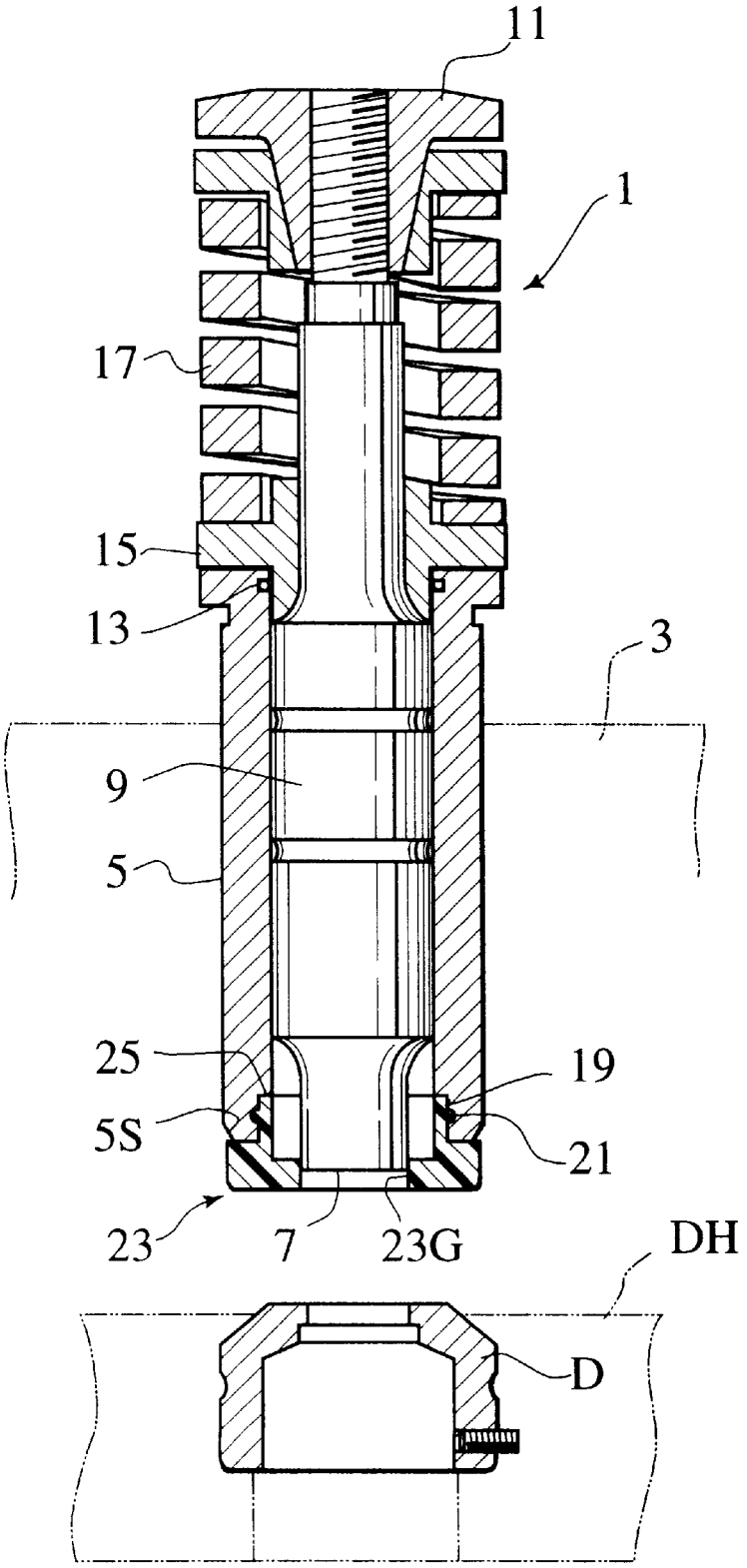
FIG. 1 is a cross sectional view of a punch assembly of the present invention.

There will be detailed below the preferred embodiments of the present invention with reference to the accompanying drawings. Like members are designated by like reference characters.

Referring now to FIG. 1, a punch assembly 1 of the present invention is provided with a cylindrical punch guide 5 which is vertically movably supported onto a turret-like punch holder 3 of a punch press, for example, a turret punch press. As being already known, the punch guide 5 is supported onto the punch holder by means of a lifter spring (not shown) so as to be situated at a predetermined height, and descends against a force by the lifter spring.

A punch body 9 having a punch portion 7 at its lower end portion is vertically movably housed in the punch guide 5. A stripper spring 17 is elastically interposed between a punch head 11 which is screwed into an upper end portion of the punch body 9 and a retainer collar 15 which is removably attached onto an upper portion of the punch guide 5 via a O ring 13.

The aforesaid punch guide 5 is provided with a fitting groove 19 at its lower end portion. An inner peripheral face of the fitting groove 19 is formed with an inner circumferential groove 21 which is one example as a stopper concave portion. The fitting groove 19 is removably fitted with a cylindrical projecting portion 25 of a blank holder 23.

Figure 2:
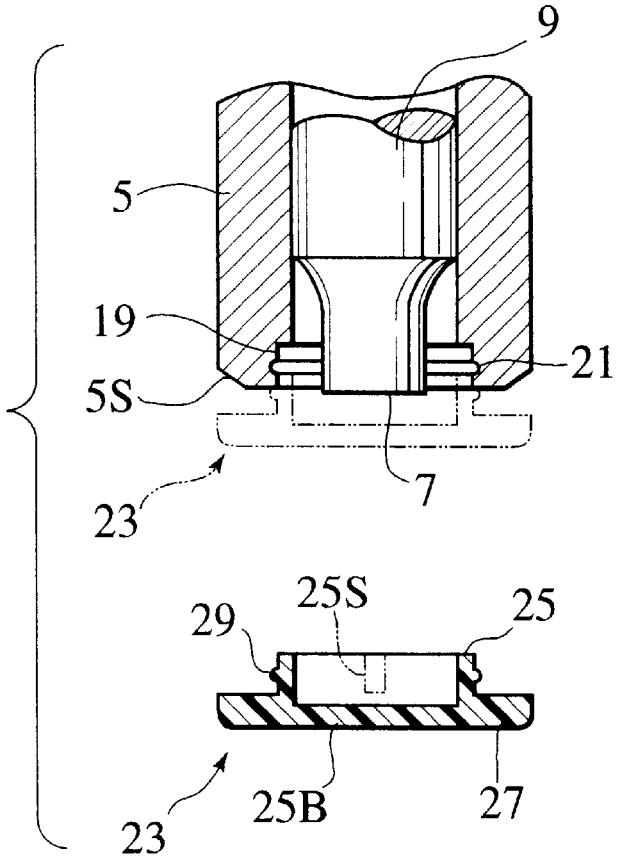
FIG. 2 is an explanatory view of an operation for attaching a blank holder onto a punch guide.

The blank holder 23 is made of a synthetic resin or proper metal. As shown in FIG. 2, the blank holder 23 has a disc-like flange 27 and the aforesaid projecting portion 25 which projects from the flange 27. An outer peripheral face of the projecting portion 25 is formed with an annular protrusion 29 which is one example as a stopper convex portion capable of engaging with the inner circumferential groove 21 formed in the punch guide 5.

A bottom portion 25B on the inner side of the projecting portion 25 is formed so as to have a thickness thinner than a thickness of the outer-side flange 27 of the projecting portion 25. Preferably, the projecting portion 25 is provided with proper slits 25S in number so that the projecting portion 25 is easy to be elastically deformed when fitting the projecting portion 25 of the blank holder 23 into the fitting groove 19 of the punch guide 5.

Further, in order to facilitate fitting the projecting portion 25 of the blank holder 23 into the fitting groove 19, preferably, the lower end portion of the groove 19 and the peripheral edge on an upper portion of the projecting portion 25 are subjected to chamfering so as to form a taper guide face therein.

Furthermore, in order to facilitate a removal of the blank holder 23 fixedly fitted into the fitting groove 19 of the punch guide 5, opposite sides of the lower end portion of punch guide 5 are symmetrically formed with an inclined plane 5S so that a distance between the blank holder 23 and the punch guide 5 becomes wider toward the outside thereof. Also, if the inclined plane 5S is formed over the entire circumstance of the punch guide 5, there is formed a conical taper face.

Now, in the case where the projecting portion 25 of the blank holder 23 is fitted into the groove 19 of the punch guide 5, a distal end portion of the projecting portion 25 of the blank holder 25 is lightly fitted into the groove 19 as shown by the two dotted line of FIG. 2 in a state that the punch body is housed in the punch guide 5. And then, the blank holder 23 is temporarily held onto the punch guide 5.

Figure 3:
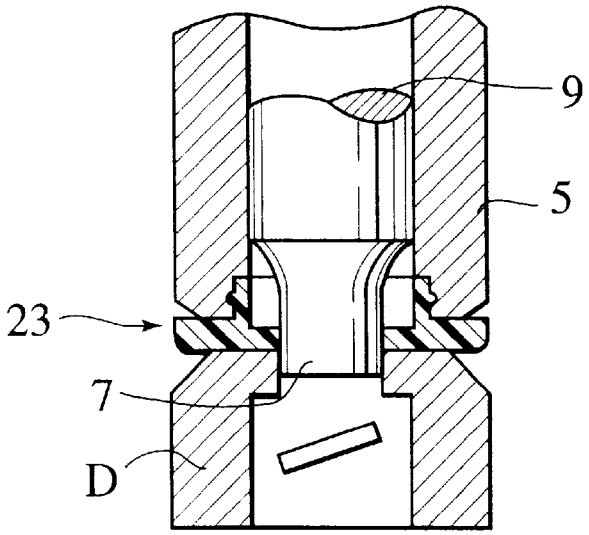
FIG. 3 is an explanatory view of an operation for punching a punch guide hole in the blank holder together with the blank holder attachment.
Figure 4:
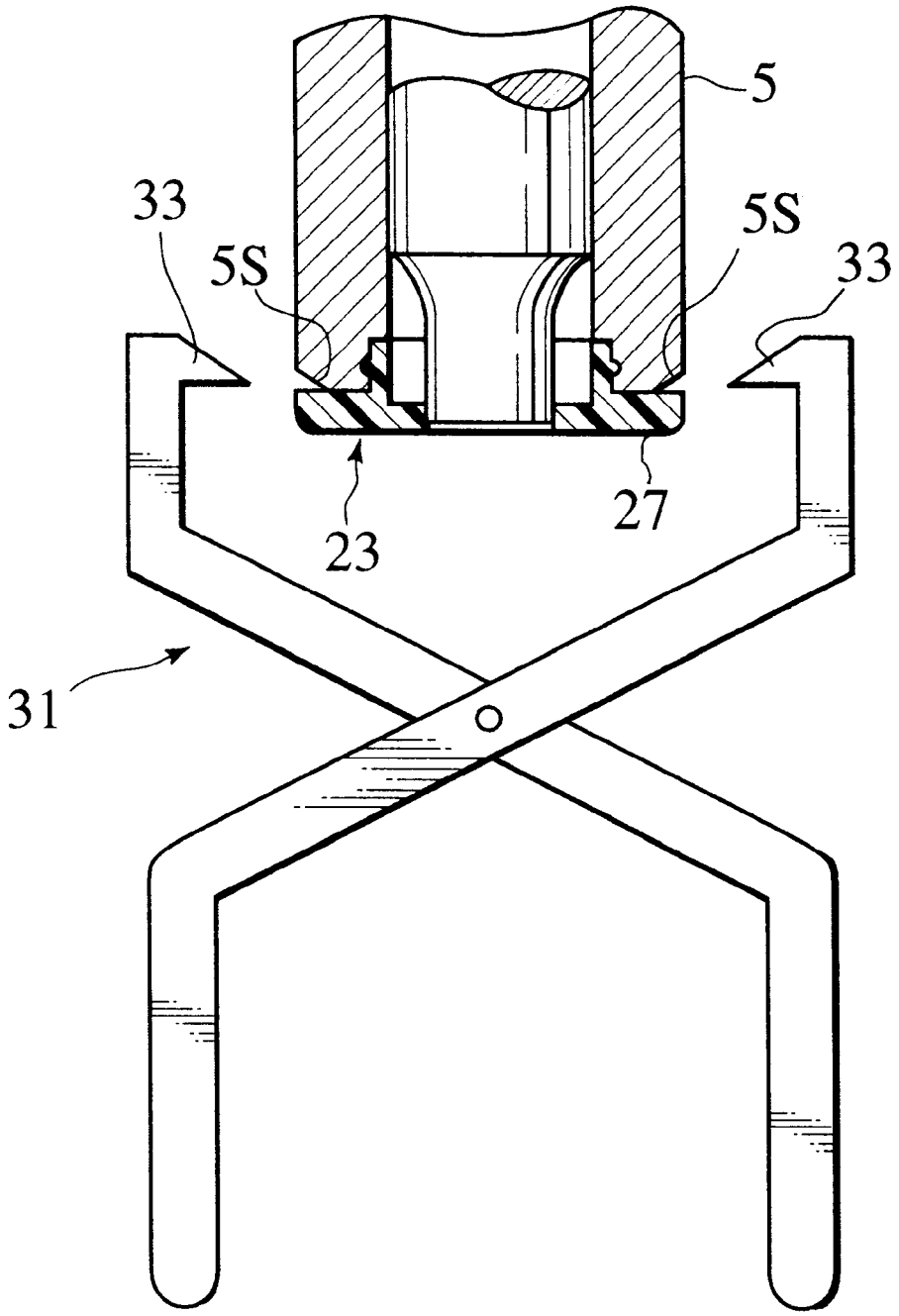
FIG. 4 is an explanatory view of an operation for removing the blank holder from the punch guide.

Thereafter, by taking use of a pressing force by a ram, striker or the like in the punch press, the punch head 11 is pressed down by means of the ram, striker or the like so that the punch body 9 descends, and simultaneously, the punch guide 5 descends together with the punch body 9 against a force of the lifter spring (not shown). Successively, when the blank holder 23 is pressed against a die D which is attached onto a die holder DH provided opposite to the punch assembly 1, the projecting portion 25 of the blank holder 23 is forcedly fitted into the groove 19 of the punch guide 5 while a punch guide hole 23G being punched in the blank holder 23 by punching of the aforesaid punching portion 7 (see FIGS. 1 and 3).

In this case, since the flange 27 is formed thicker than the thickness of the bottom portion 25B on the inner side of the projecting portion 25 of the blank holder 23, the projecting portion 25 is securely fitted into the groove 19, and punching of the punch guide hole 23G is carried out in a state that the flange 27 is sandwiched in between the die D and the lower end portion of the punch guide 5.

In the manner as described above, the blank holder 23 has been used for a long time in a state that the projecting portion 25 of the blank holder 23 is fitted into the groove 19 of the punch guide 5. Thereafter, in the case where the using blank holder 23 is replaced with a new blank holder due to a deterioration or damage caused therein, a pair of opening and closing pawl portions 33 provided in a removal tool 31 is interposed between the inclined plane 5S formed in the punch guide 5 and the flange 27 of the blank holder, and then, a distance between the pair of pawl portions 33 gradually makes narrow. Whereby a component in a direction of removing the blank holder 23 from the punch guide 5 acts on by an existence of the inclined plane 5S, and an engagement of an inner circumferential groove as the stopper concave portion 21 of the fitting groove 19 with the stopper convex portion 29 of the projecting portion 25 is released, so that the blank holder 23 can be readily removed from the punch guide 5.

As described above, the blank holder 23 is removed from the punch guide 5, and thereafter, a new blank holder 23 is temporarily held in the lower end portion of the punch guide 5 as described before. And then, when the aforesaid operation is repeated, the new blank holder 23 is attached with respect to the punch guide while the punch hole 23G being punched therein.

Figure 5:
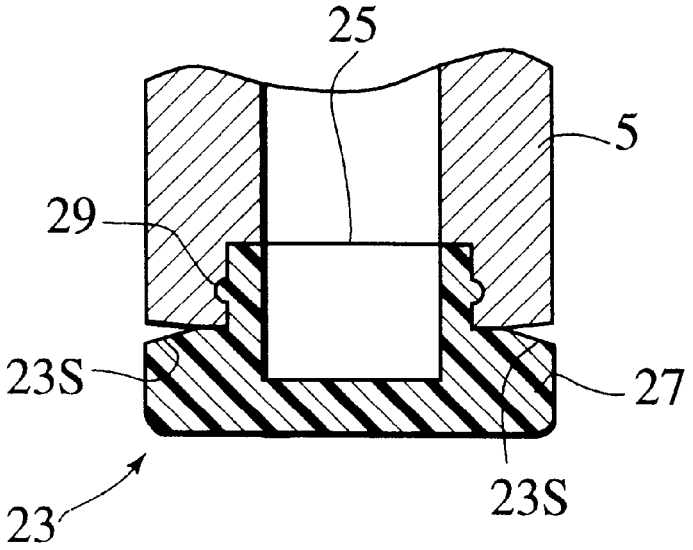
FIG. 5 is an explanatory view showing a second embodiment of the present invention.

Moreover, in order to facilitate a removal of the blank holder 23 from the punch guide 5, as shown in FIG. 5, an upper face of the flange 27 of the blank holder 23 may be formed with an inclination plane 23S instead of forming the inclined plane 5S in the lower end portion of the punch guide 5. Also, the inclined plane may be formed both in the punch guide 5 and in the blank holder 23.

Figure 6:
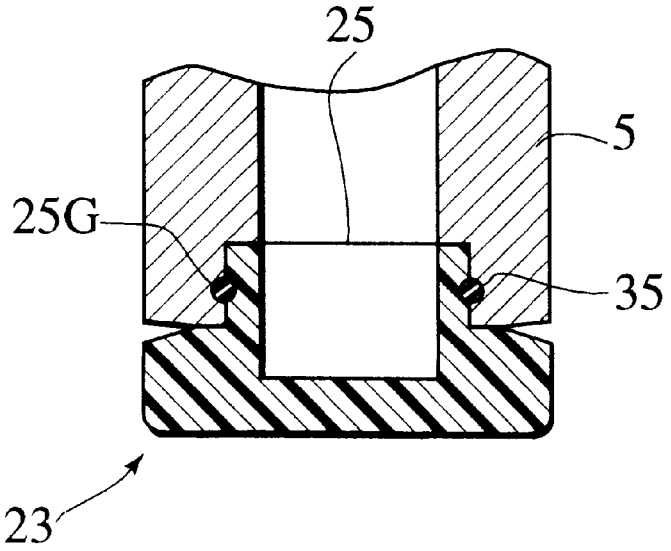
FIG. 6 is an explanatory view showing a third embodiment of the present invention.

As shown in FIG. 6, the outer peripheral face of the projecting portion of the blank holder 23 is formed with a circumferential groove 25G. The circumferential groove 25G may be provided with an elastic member such as an O ring, etc.

With the construction in which the blank holder 23 is provided with the elastic member 35 as described above, when attaching the blank holder 23 made of rigid material to the punch guide 5, the attachment of the blank holder 23 can be readily achieved even in the case where the projecting portion 25 is hard to be elastically deformed.

With aforesaid construction, the elastic member 35 exhibits a function as an annular stopper convex portion. Thus, the elastic member 35 is elastically deformed when being fitted into to the groove 19. Therefore, this serves to prevent the elastic member 35 from being chipped off by an edge portion of the groove 19.

While preferred embodiment of the present invention have been described using specific terms, such description is for illustrative purposes, and it is to be understood that changes and variations may be made without departing from the spirit or scope of the following claims.

What is claimed is:

1. A punch assembly, comprising:

a punch guide to be vertically removably supported in a punch holder, the punch guide being formed with a fitting hole at a lower end of the punch guide;

a punch body being vertically movably supported in the punch guide, the punch body including a punching portion at a lower end of the punch body; and a blank holder further including:

a cylindrical projecting portion to be inserted into the fitting hole of the punch guide in such a manner that an outer peripheral portion of the cylindrical projecting portion directly contacts with an inner peripheral portion of the fitting hole;

a bottom portion located at a lower end of the blank holder; and a flange located at an outer peripheral portion of the bottom portion so as to surround the bottom portion, wherein the bottom portion of the blank holder has a thickness thinner than that of the flange;

wherein the bottom portion of the blank holder is punch out by the punching portion of the punch body after the blank holder is mounted in the punch guide so that the cylindrical projecting portion is inserted into the fitting hole of the punch guide;

wherein the bottom portion of the blank holder is located below a bottom end surface of the punch guide; and wherein the punch guide is partially formed with an inclined plane at an outer peripheral face on the lower end of the punch guide.

2. The punch assembly according to claim 1, wherein the flange of the blank holder is partially formed with an inclined plane at an outer peripheral face on an upper end of the flange.

3. The punch assembly according to claim 2, wherein the blank holder is made of a rigid resin.

4. The punch assembly according to claim 2, wherein the blank holder is made of a rigid metal.

* * * * *